US005104117A

United States Patent [19]

McCormick et al.

[11] Patent Number: 5,104,117

[45] Date of Patent: Apr. 14, 1992

[54] PAPER SHEET SORTING APPARATUS

[75] Inventors: Walter A. McCormick, Bellevue; Wilbur J. Kellum, III, Redmond; Gregory Phillips, Seattle, all of Wash.

[73] Assignee: EMF Corporation, Redmond, Wash.

[21] Appl. No.: 401,529

[22] Filed: Aug. 30, 1989

Related U.S. Application Data

[63] Continuation of Ser. No. 144,475, Jan. 15, 1988, abandoned.

[51] Int. Cl.[5] ..... B65H 31/24

[52] U.S. Cl. ..... 271/297; 271/305; 162/197; 162/271; 493/459

[58] Field of Search ..... 271/296, 297, 303, 305; 162/197, 271; 493/459

[56] References Cited

U.S. PATENT DOCUMENTS

| | | | |
|---|---|---|---|
| 1,691,023 | 12/1925 | Dye . | |
| 2,012,953 | 1/1932 | Brunner et al. . | |
| 2,919,917 | 1/1960 | Worswick | 271/64 |
| 2,922,640 | 1/1960 | Fornell et al. | 270/58 |
| 3,252,570 | 5/1966 | Smith | 271/305 |
| 3,262,697 | 7/1966 | Krinke | 271/33 |
| 3,709,480 | 1/1973 | Schulze et al. | 270/58 |
| 3,709,492 | 1/1973 | Baker | 271/297 X |
| 3,774,906 | 11/1973 | Fagen et al. | 271/64 |
| 3,802,694 | 4/1974 | Post et al. | 270/58 |
| 3,841,754 | 10/1974 | Drexler et al. | 355/17 |
| 3,857,560 | 12/1974 | Gundlach | 271/33 |
| 3,937,459 | 2/1976 | Lawrence | 271/173 |
| 3,944,207 | 3/1976 | Bains | 271/297 X |
| 3,944,217 | 3/1976 | Greene et al. | 271/173 |
| 3,948,510 | 4/1976 | Iwamoto et al. . | |
| 3,971,696 | 7/1976 | Manfredi . | |
| 3,973,769 | 8/1976 | Cross et al. | 271/173 |
| 3,977,667 | 8/1976 | Cross et al. | 271/64 |
| 3,988,018 | 10/1976 | Tusso et al. | 271/173 |
| 3,990,695 | 11/1976 | Cross et al. | 271/64 |
| 4,015,841 | 4/1977 | Mitsumasu | 271/173 |
| 4,157,822 | 6/1979 | Miller | 271/3.1 |
| 4,204,727 | 5/1980 | Tates | 355/3 R |
| 4,221,379 | 9/1980 | Kamath et al. | 271/289 |
| 4,228,995 | 10/1980 | Breuers et al. | 271/292 |
| 4,232,861 | 11/1980 | Maul | 271/287 |
| 4,248,525 | 2/1981 | Sterrett | 355/14 SH |
| 4,297,025 | 10/1981 | Bach et al. | 355/145 H |
| 4,299,382 | 11/1981 | Ichikawa | 271/297 X |
| 4,300,891 | 11/1981 | Bemiss . | |
| 4,318,542 | 3/1982 | Altmann et al. | 271/290 |
| 4,344,614 | 8/1982 | Kaneko et al. | 271/288 |
| 4,352,490 | 10/1982 | Hatakeyama | 271/289 |
| 4,374,212 | 2/1983 | Martellock et al. . | |
| 4,428,572 | 1/1984 | Burke | 271/297 |
| 4,452,440 | 6/1984 | Fagen et al. | 271/3.1 |
| 4,469,323 | 9/1984 | Miyashita et al. | 271/288 |
| 4,493,484 | 1/1985 | Eyer | 271/297 X |
| 4,496,143 | 1/1985 | Weyer | 271/112 |
| 4,498,665 | 2/1985 | Watanabe | 271/289 |
| 4,505,695 | 3/1985 | Billings . | |
| 4,515,458 | 5/1985 | Masuda et al. | 355/3 SH |
| 4,530,593 | 7/1985 | Kasuya et al. | 355/14 R |
| 4,578,582 | 3/1986 | Takano | 250/327.2 |
| 4,592,543 | 6/1986 | Tanimoto et al. . | |

FOREIGN PATENT DOCUMENTS

| | | | |
|---|---|---|---|
| 1494325 | 12/1977 | United Kingdom | 15/58 |

OTHER PUBLICATIONS

Opcon Inc. Advertisement, *Machine Design*, Oct. 1984, p. 108.

*Primary Examiner*—Richard A. Schacher
*Attorney, Agent, or Firm*—David L. Garrison

[57] ABSTRACT

A apparatus for recurling, transporting, sorting and stacking individually fed sheets of paper received from devices such as printing or duplicating machinery. A recurler, comprising a plurality of recurleer belts, trained about a drive roller, a feed roller, and a forward roller, against which a recurler roller is urged, is provided for recurling all sheets entering the enclosure of the sorting apparatus. A conveyor belt assembly urges the sheets against the upper surfaces of a plurality of deflectors to convey the sheets through the enclosure. A lower surface of each deflector selectively deflects the sheets into designated receiving trays, or optionally allows the sheets to be expelled from the enclosure.

23 Claims, 7 Drawing Sheets

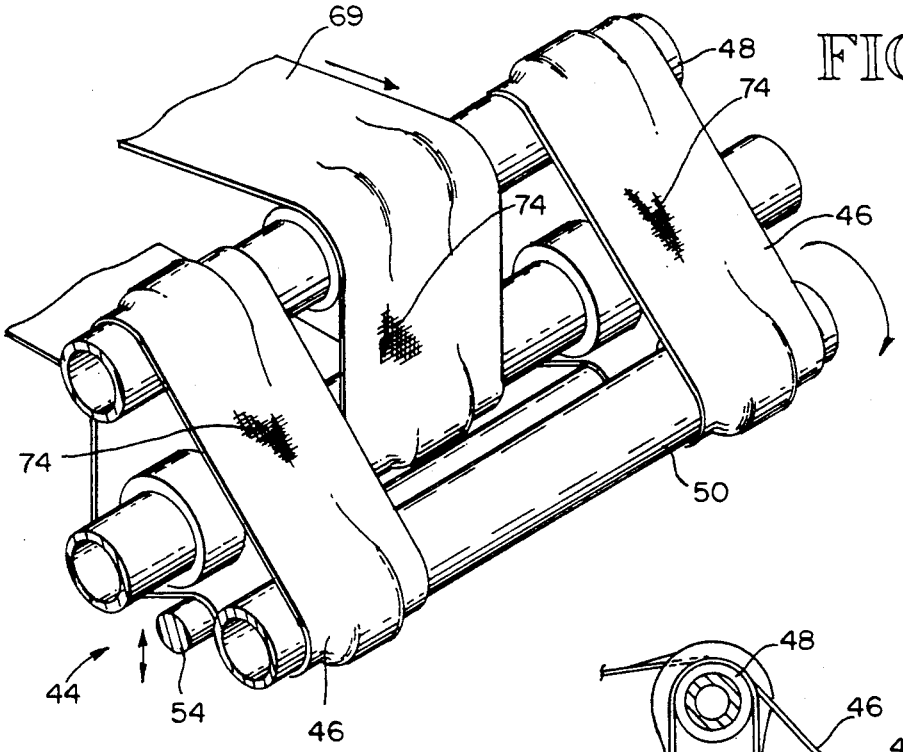
FIG. 4
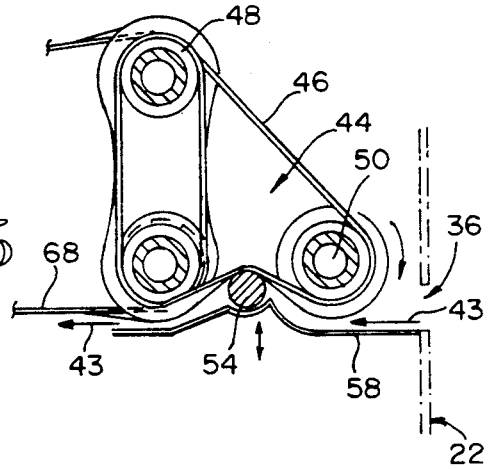
FIG. 5
FIG. 6
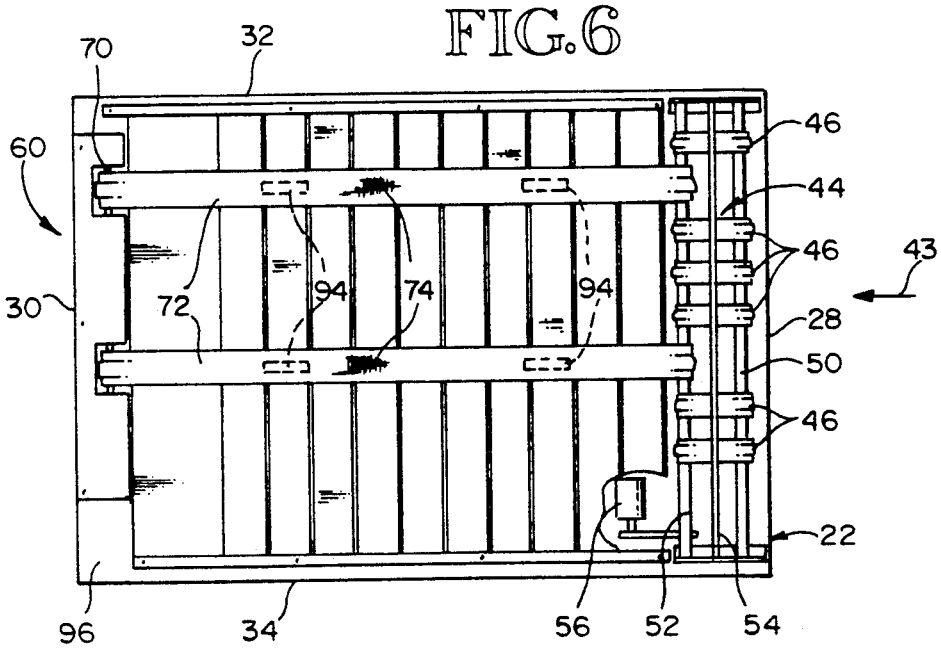

FIG. 7
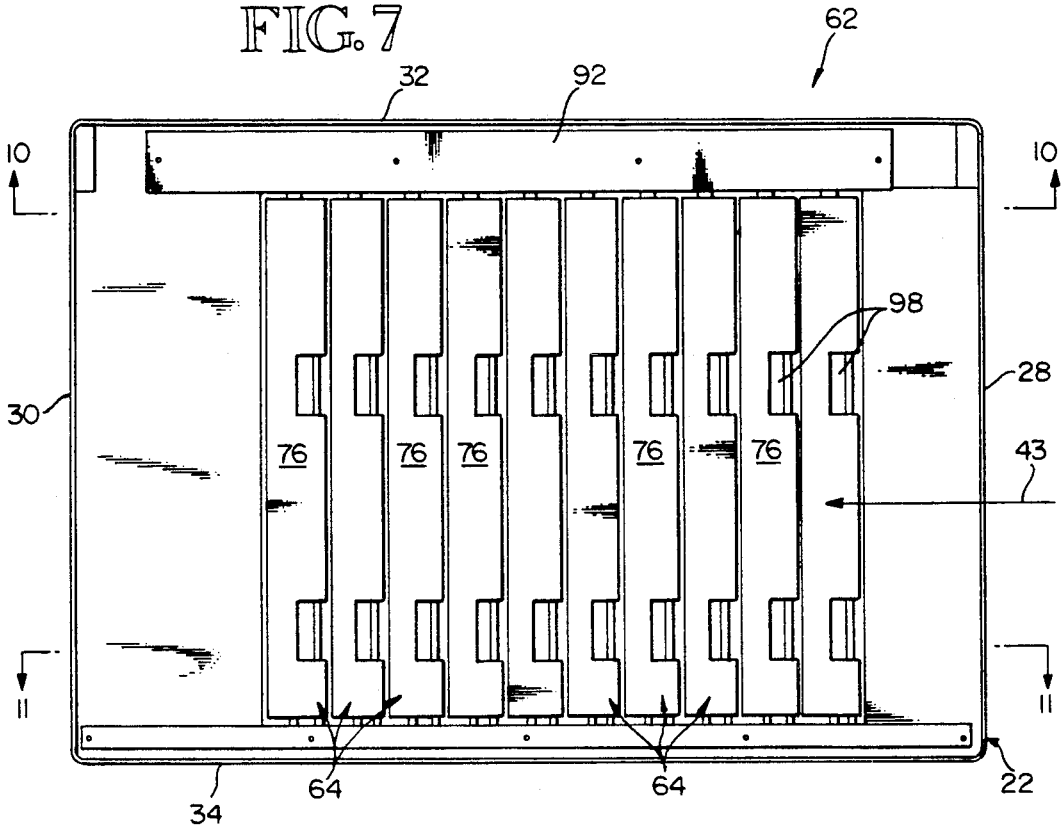
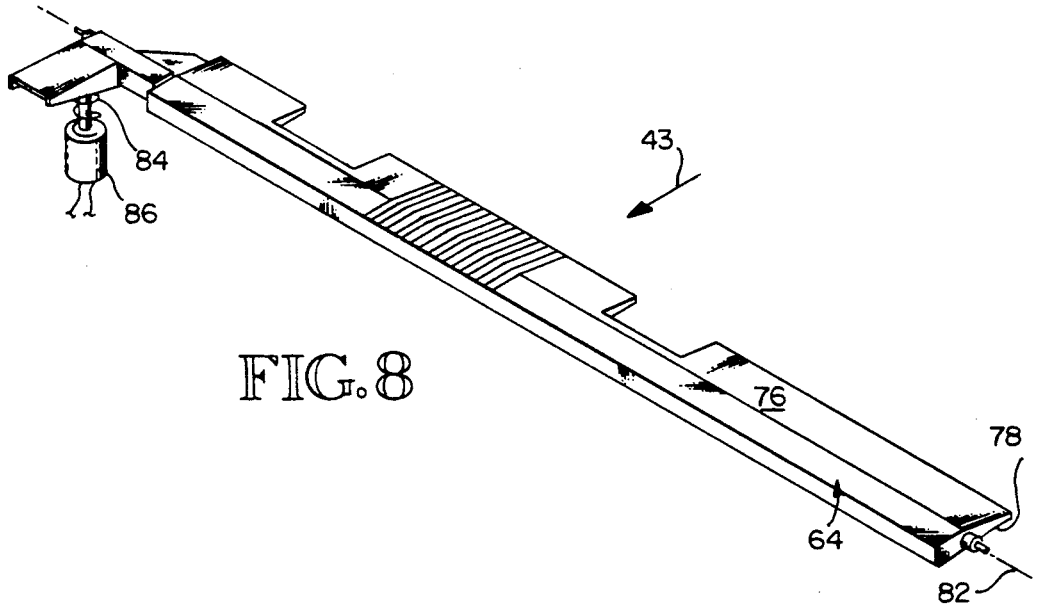
FIG. 8

FIG. 9
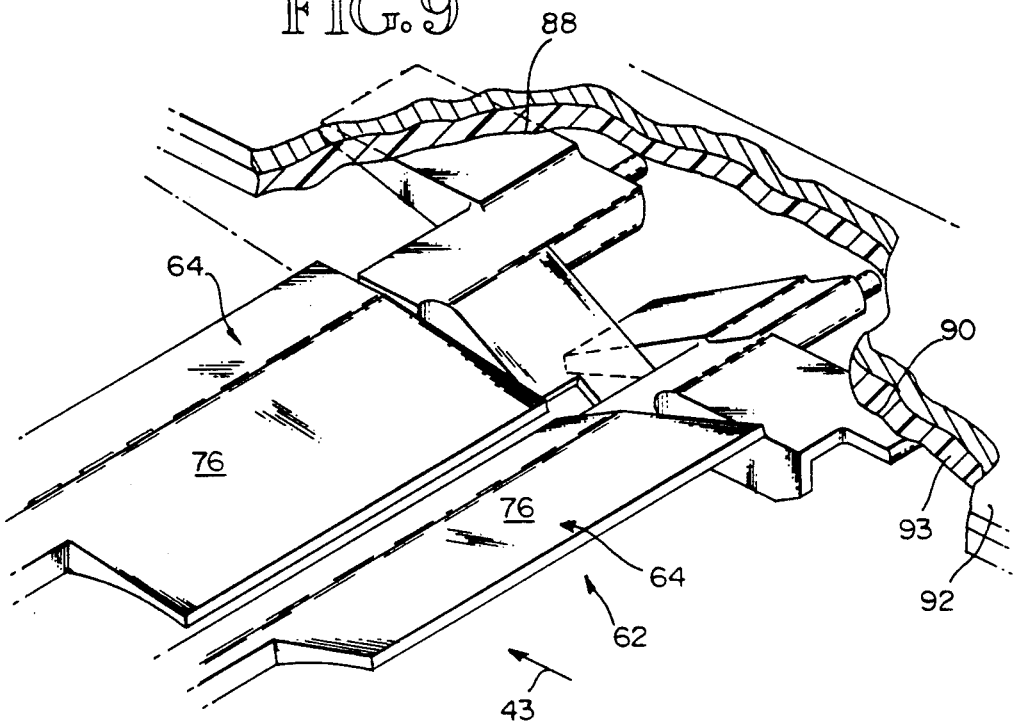
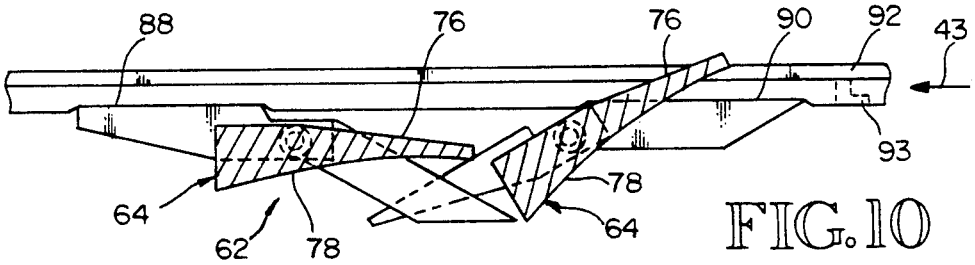
FIG. 10
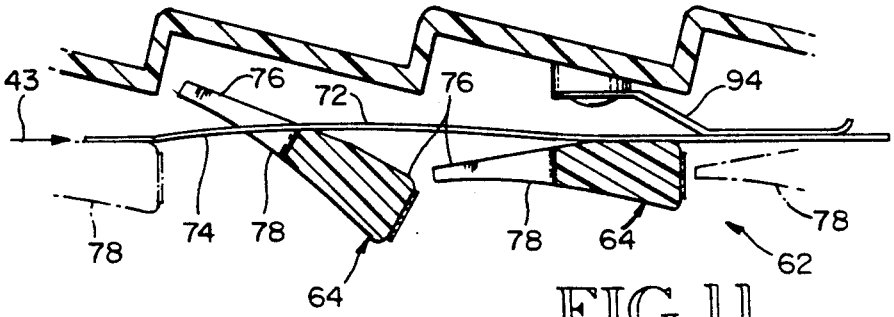
FIG. 11

PAPER SHEET SORTING APPARATUS

This is a continuation of co-pending application Ser. No. 07/144,475 filed on Jan. 15, 1988, now abandoned.

TECHNICAL FIELD

This invention relates to sheet transport and sorting apparatus used to transport and sort individually fed sheets of paper into separate, easily defined job stacks. More specifically, the present invention relates to a paper sorting apparatus which recurls, conveys, deflects and sorts paper sheets which are individually fed from a large-volume, high-speed document printing or duplicating device.

BACKGROUND ART

Within the printing and photocopying industries there has been a great need for various types of sheet handling equipment, including sorting apparatus. Numerous sorters, created in an attempt to meet that need, have been disclosed in issued patents.

Commonly assigned patents, Fagan et al. (U.S. Pat. No. 3,774,906) and Greene et al. (U.S. Pat. No. 3,944,217), disclose two types of paper sheet sorting and collating devices having various conveyor belt systems and deflecting mechanisms. Fagan et al. ('906) discloses a sorting and collating apparatus, wherein the sheets travel upon a conveyor belt system across the apparatus from a feed source. The sheets then travel downward until they are deflected by triangular deflector teeth, which extend out from within the vertical sheet conveyor, into one of several awaiting vertically-indexed, inclined trays. Greene et al. ('217) discloses a tower type sorting and collating apparatus incorporating the features described and claimed in EMF Corporation (British Patent No. 1,494,325), wherein the sheets travel across the apparatus and then travel upward until they are deflected by one of several awaiting deflectors, which extend out from within the vertical conveyor, into one of several awaiting vertically-indexed, horizontal trays. A mass airflow is used in each of these disclosures to hold the sheets against the conveyor system.

Fornell et al. (U.S. Pat. No. 2,922,640) discloses a collating machine having a traveling drum depository or bin.

Schulze et al. (U.S. patent No. 3,709,480), Post et al. (U.S. Pat. No. 3,802,694), Drexler et al. (U.S. Pat. No. 3,841,754), Lawrence (U.S. Pat. No. 3,937,459), Cross et al. (U.S. Pat. No. 3,973,769), Cross et al. (U.S. Pat. No. 3,977,667), Tusso et al. (U.S. Pat. No. 3,988,018), Cross et al. (U.S. Pat. No. 3,990,695), Tates (U.S. Pat. No. 4,204,727), Kamath et al. (U.S. Pat. No. 4,221,379), Breuers et al. (U.S. Pat. No. 4,228,995), Sterrett (U.S. Pat. No. 4,248,525), Kanek et al. (U.S. Pat. No. 4,344,614), Hatakeyama (U.S. Pat. No. 4,352,490), Burke (U.S. Pat. No. 4,428,572), Miyashita et al. (U.S. Pat. No. 4,469,323), Watanabe (U.S. Pat. No. 4,498,665), Masuda et al. (U.S. Pat. No. 4,515,458), Kasuya et al. (U.S. Pat. No. 4,530,593), and Takano (U.S. Pat. No. 4,578,582) disclose various sorting or collating devices, wherein the paper sheets are deposited into vertically-indexed, generally horizontal receiving trays.

Worswick (U.S. Pat. No. 2,919,917), Mitsumasu (U.S. Pat. No. 4,015,841), Maul (U.S. Pat. No. 4,232,861), and Altmann et al. (U.S. Pat. No. 4,318,542) disclose sorting or distributing devices having a means to horizontally transport paper sheets through the apparatus and deflect the sheets into horizontally-indexed, vertically inclined sorting or receiving bins. The transporting means include pinch rollers and/or conveyors. The deflecting means include a plurality of vanes which protrude out from within the conveyor, the combination of a plurality of gates and shutters, a plurality of routing flaps located below the transporting means, and the combination of a plurality of movable guide prawls. Altmann et al. ('542) teaches that a flow of air should hold the paper sheet against the lower face of the conveyor.

These disclosures are believed to illustrate the general scope of the prior art related to sorting equipment. The applicants submit that these disclosures, taken alone or together, do not teach the concepts embodied in this invention.

DISCLOSURE OF INVENTION

It is a general object of the present invention to provide a paper sorting apparatus capable of sorting individually fed sheets of paper, received from a printing or copying device, into individual job stacks on a large-volume, high-speed, continuous or semi-continuous basis.

A further object is to provide an apparatus which minimizes jamming of sheets during operation.

A still further object is to provide an apparatus having a recurling means capable of recurling the paper sheets, to remove or reduce curl-up, as they enter the apparatus.

Another object is to provide an apparatus having a conveying means capable of conveying the sheets through the sorting apparatus without using successive pinch wheels or a mass air-flow.

Another object is to provide an apparatus having a conveying means capable of selectively passing the sheets to an adjacent sorter, stacker, proof tray, or other sheet handling device.

Another object is to provide an apparatus having a deflecting means which serves the dual purpose of alternatively defining a sheet support surface or a sheet deflecting surface.

Another object is to provide an apparatus having a deflecting means which during operation is urged against a noise-suppressant material to minimize operational noise.

Another object is to provide an apparatus wherein the conveying means may be raised from the deflecting means to allow for maintenance of the apparatus and for removal of any jammed or damaged sheets.

Another object is to provide an apparatus having a tray assembly, having a plurality of receiving trays, wherein the sheets may be sorted into separated, easily defined job stacks.

Another object is to provide an apparatus having a tray assembly wherein the individual receiving trays define a "mailbox system".

Another object is to provide an apparatus having a tray assembly wherein the contents of designated receiving trays may be secured from unauthorized inspection by use of lockable doors.

Another object is to provide an apparatus, wherein the tray assembly has a bin-full or capacity sensing means.

Another object is to provide an apparatus, wherein the tray assembly has a sheet-jamming or sheet-delivery sensing means.

The present invention allows for the uninterrupted sorting of large quantities of individually fed sheets of paper, received from a printing or duplicating device, into individual job stacks on a high-speed, continuous or semi-continuous basis. More specifically, the invention is a paper sorting apparatus capable of recurling the sheets as they enter the apparatus, conveying the sheets through the apparatus, and either expelling them from the apparatus or deflecting them into a means which sorts them into individual job stacks. To achieve these ends, the sorting apparatus has a recurling means, a conveying means, a deflecting means, and a tray assembly.

Individual sheets, from a source such as a printing or copying device, are introduced into the entrance opening of a support frame, cabinet, or enclosure which houses the sheet sorting apparatus. The apparatus may be secured to the sheet supply source with a securing means. The securing means may comprise either a hard or soft docking system. The hard docking system may be a bolt, clamp, or other appropriate securing device which joins the support frame to the printing or duplicating device. The soft docking system comprises at least one mating pin and at least one magnet. The mating pin assists in establishing the proper interface between the support frame and sheet supply source. The magnet removably secures the apparatus to the supply source which facilitates their easy joining and separation. Located immediately adjacent to the entrance opening is a recurling means into which the sheets are fed.

The recurling means recurls the sheets as they enter the sorting apparatus and insures the proper delivery of the sheets into the conveying means. Recurling the sheets is important to prevent sheet jamming, which is a common problem with sheet sorting devices. The recurling means is a positive drive mechanism having a grouping of four offset rollers. A plurality of continuous recurler belts are trained about three of the offset rollers. The forth roller, called the recurler roller, is urged against the rotating recurler belts. The recurler roller has a relatively small cross-sectional diameter. The sheets are fed between the nip of the recurler roller and the recurler belts, thereby forcing the sheet to curve around a portion of the recurler roller. The height of the recurler roller, with respect to the other rollers within the group, may be adjusted to increase or decrease the tension in the recurler belts and alter the angle through which the sheets must pass. By varying the height of the recurler roller, the recurling means may be adjusted to compensate for curl caused by varying paper weights, temperatures, and humidity. Sheet curl-up may be removed or reduced by placing the recurler roller generally below the other rollers. The recurling means also regulates the speed of the sheets as they are delivered to the conveying means. Controlling the sheets delivery speed is important to assure that the sheets are properly located along the conveying means for engagement with the deflecting means. Once recurled, the sheets are directed toward the lower run of a substantially horizontal conveying means.

The conveying means conveys the sheets horizontally along a conveying path through the enclosure without using successive pinch wheels or mass air-flow. The conveyed sheets may be deflected into the tray assembly by the deflecting means, or passed to an adjacent stacker, proof tray, or other sheet handling device. The conveying means has a conveyor belt assembly trained about a drive roller, a forward roller, and a rearward roller. The drive, forward, and rearward rollers are positioned to cause the conveyor belt assembly to be adjustably and rotatably taut. The conveyor belt assembly comprises a plurality of relatively flat, parallel, spaced-apart, continuous conveyor belts having a tacky outer surface. Applicants prefer to construct the conveyor belt assembly from a flexible, stretchable, foraminous or porous, mesh-like material, such as a spandex material. Such material easily conforms its shape to the crowned rollers about which it is trained. Lightweight pressure straps, located above the lower run of the conveyor belt assembly, press down against the conveyor belts, urging the belts away from the conveying means.

The deflecting means serves the dual purpose of alternatively defining a sheet support surface against which the sheets are pressed during conveyance, or a sheet deflecting surface for sorting and deflecting the sheets into the tray assembly. The deflecting means comprises a plurality of relatively flat, parallel, abutting deflectors which span the width of the conveying means. It is important to substantially abut the successive deflectors to prevent the sheets from becoming jammed therebetween. Each deflector is mounted to pivot about a longitudinal axis, and a has relatively flat upper surface and a slightly concave lower surface.

The deflectors are normally lowered, allowing the sheets to travel across their upper surface. The upper surface of the deflectors define the sheet support surface against which the sheets are urged during conveyance. The sheets are held against and transported across the sheet support surface of the deflectors by the moving conveyor belts, which in turn are pressed downward by the lightweight pressure straps. The tacky outer surface of the conveyor belts, have a high coefficient of friction, thereby gripping the sheets and easily overcoming the frictional resistance caused by the sheet support surface which has a low coefficient of friction.

If each successive deflector is maintained out of the conveying path, as a sheet travels horizontally though the enclosure, the sheet bypasses the tray assembly and is ejected from the apparatus through an exit opening. An adjacent sorter, stacker, proof tray, or other sheet handling device may be attached to the apparatus near the exit opening to receive the ejected sheets. This procedure allows the sheets to be selectively passed through the enclosure without their being deposited and stacked within the tray assembly. This procedure may be automatically followed where a receiving tray or the tray assembly is jammed or full.

The deflectors may be pivoted by a solenoid means to extend into the conveying path between the conveyor belts, causing the concave lower surface or sheet deflecting surface of the deflector to deflect the sheet away from the conveying means toward the tray assembly. A separate deflector is provided for each receiving tray in the tray assembly. In the preferred embodiment, the deflectors extend past the conveying path and provision is made within the housing of the conveying means to accommodate the forward ends of the deflectors. To minimize the operational noise level, the deflectors are urged against noise-suppressant material in both the normally disengaged position and raised engaged position. The noise-suppressant material defines a disengaged position stop when the deflector is in the disengaged position, and an engaged position stop when the deflector is in the engaged position. The concave shape of the sheet deflecting surface assists to direct the sheets downward into the tray assembly.

The tray assembly separates the sorted sheets and serves as a depository where the sheets may be stacked into separate, easily defined job stacks. The tray assembly comprises a plurality of individual, horizontally-indexed receiving trays inclined slightly from the vertical, which are located below the deflecting means. Each deflector corresponds to a specific receiving tray. The receiving trays are inclined from the vertical to facilitate jogging of the sheets into uniform job stacks in the direction of sheet travel. As the sheets are deposited, gravity and momentum cause the sheets to become aligned against the tray floor and tray side wall. A single or dual paper-bail means may also be used in each tray to direct the sheets away from the deflecting means downward toward the tray floor and tray side wall. Thus, the sheets are passively positioned into a neat stack within the receiving trays. The job stacks and sheets are easily removed from the receiving trays within the enclosure though an access opening.

The tray assembly may function as a "mailbox system", allowing designated sheets to be directed and deposited in specifically identified receiving trays, whereupon they may be removed by the recipient. Individual, lockable doors may be used to restrict unauthorized removal or inspection of the contents of designated receiving trays. In the preferred embodiment, the tray assembly has ten receiving trays. The tray assembly may be built with a fewer or greater number of receiving trays. Multiple units of this sorting apparatus may be abutted and secured in tandem to facilitate even a larger number of available "mailboxes" or receiving trays.

The sorting apparatus may be operated to allow the recurling, conveying, sorting, deflecting, and stacking of the sheets into the various receiving trays until a bin-full or capacity sensing means, or a sheet-jamming or sheet-delivery sensing means is activated. The capacity sensing means prevents overstacking and jamming of the receiving trays. Each receiving tray has its own capacity sensing means. In the preferred embodiment, the capacity sensing means is triggered by the proximity of the paper-bail within each receiving tray to a magnetically controlled switch. Once tripped, a capacity sensing means may prevent further sheets from entering that specific receiving tray by assuring that the deflector corresponding to that receiving tray is not engaged. The incoming sheets may still be conveyed and deposited into the remaining receiving trays, or alternatively, they may be expelled from the sorting apparatus until the full receiving tray is emptied. This invention, therefore, permits the uninterrupted, high-speed, continuous or semi-continuous, sorting and stacking of large quantities of sheets into individual job stacks within separate receiving trays.

Similarly, a sheet-jamming or sheet-delivery sensing means may be used to verify that the sheets are being deposited within the proper receiving tray. A light activated switch may be used for this purpose, where an optical path is provided near the top of the tray assembly below the deflecting means. The sheet-delivery sensing means is activated when a sheet is not properly deposited within the tray assembly. Once activated, the sheet-delivery sensing means may cause the activation of an operator warning signal and terminate the operation of the feeding source and the sorting apparatus.

The conveying means may be positioned within a hinged canopy which can be raised or lifted above the deflecting means. Raising of the conveying means allows for easy maintenance of the apparatus and for removal of any jammed or damaged sheets from within the enclosure.

BRIEF DESCRIPTION OF DRAWINGS

FIG. 4 is a partial perspective view of the recurling means as shown in FIG. 2 and FIG. 3.

FIG. 5 is a partial side elevational view of the recurling means as shown in FIG. 4.

FIG. 6 is a plan view of the conveying means and recurling means as shown in FIG. 2 with the guiding means being attached to the canopy and having a portion broken away to show the recurling means.

FIG. 7 is a plan view of the deflecting means as shown in FIG. 2 and FIG. 3.

FIG. 8 is a perspective view of a deflector as shown in FIG. 2, FIG. 3, and FIG. 7.

FIG. 9 is a partial perspective view of the deflecting means as shown in FIG. 2, FIG. 3 and FIG. 7 with a portion of the stop bar and noise-suppressant material being broken away, wherein the deflector to the left is in a disengaged position being registered against a disengaged position stop and the deflector to the right is in an engaged position being registered against an engaged position stop.

FIG. 10 is a partial cross-sectional view of the plane defined by the line 10—10 shown in FIG. 7, wherein the deflector to the left is registered against the disengaged position stop and the deflector to the right is registered against the engaged position stop.

FIG. 11 is a partial, cross-sectional view of the plane defined by the line 11—11 shown in FIG. 7.

BEST MODE FOR CARRYING OUT THE INVENTION

Figure 1:
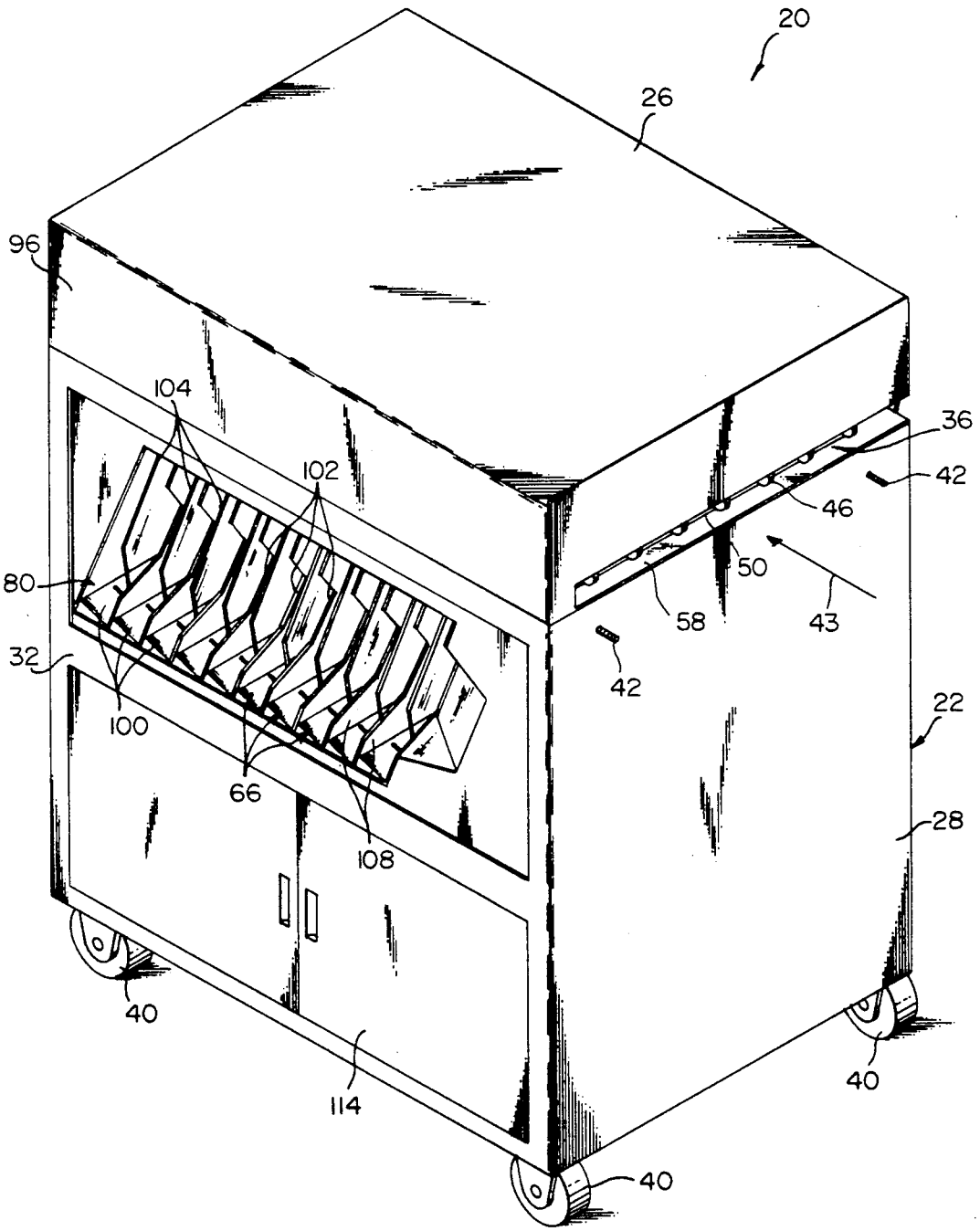
FIG. 1 is a perspective view of the preferred embodiment of the sheet sorting apparatus made in accordance with this invention.

Referring to the drawings and particularly to FIG. 1, wherein like numerals indicate like parts, the paper sorting apparatus 20 has an upstanding generally rectangular support frame 22. Support frame 22 defines an enclosure which has a base 24, a lid 26, an entrance wall 28, an exit wall 30, a front wall 32, and a back wall 34.

Located near the top of entrance wall 28 is an entrance opening 36. Entrance opening 36 is an elongated rectangular slot through which paper sheets may enter the enclosure from a feeding or supply source. Commonly, the feeding or supply source is a printing or duplicating device.

Located near the top of exit wall 30 is an exit opening 38. Exit opening 38 is an elongated rectangular slot through which the sheets may be expelled from within the enclosure toward an adjacent sorter, stacker, proof tray, or other sheet handling device. The sheets are only expelled from the enclosure if they are not deflected and sorted within sorting apparatus 20.

Support frame 22 may sit directly upon the floor, upon leveling pedestals, or upon caster wheels 40. If caster wheels are used, support frame 22 should be secured to the feeding or supply source to insure the proper feeding of the sheets into entrance opening 36. This may be accomplished by using a securing means, which is attached to support frame 22. The securing means may comprise either a hard or soft docking system. The hard docking system may be a bolt, clamp, or other appropriate securing device which secures apparatus 20 to the feeding or supply source. The soft docking system comprises at least one mating pin 41 and at least one magnet 42. Mating pin 41 is secured to entrance wall 28 by any conventional means. Mating pin 41 is positioned to mate into a hole provided in the supply source, such that, when mated, the sheets are properly fed into the enclosure. Mating pin 41 prevents the lateral misalignment between apparatus 20 and the supply source. Magnet 42, which preferably comprises a permanent magnet, is secured to entrance wall 28 to removably secure apparatus 20 to the supply source. The applicants prefer using the soft docking system because it allows the proper, secured interface between apparatus 20 and the sheet supply source, and allows for their easy joining and separation. Holes 45 may also be provided in exit wall 30 so that successive apparatus 20 may be attached together in tandum.

Upon entering the enclosure through entrance opening 36, the sheets are fed along a conveying path 43 into a recurling means 44 which is located immediately adjacent to entrance opening 36.

Recurling means 44, as illustrated in FIG. 4, is a positive drive mechanism secured to support frame 22. Recurling means 44 extends substantially across the entire width of entrance opening 36, and has a plurality of continuous recurler belts 46 trained about a grouping of three offset rollers: a drive roller 48, a feed roller 50, and a forward roller 52. Feed roller 50 is located in close proximity to entrance opening 36. Forward roller 52 is positioned approximately at the same elevation as feed roller 50, but slightly further into the enclosure. A fourth roller, called the recurler roller 54, is urged against the outer run of recurler belts 46. Drive roller 48 is rotatably attached to a powered rotating motor 56, thereby driving recurler belts 46. Recurler belts 46 engage and rotate feed roller 50, forward roller 52 and recurler roller 54.

Recurler roller 54 has a relatively small cross-sectional diameter. After entering the enclosure, the sheets are directed by a guiding means 58 toward the nip of recurler roller 54 and the outer run of recurler belts 46. Guiding means 58 serves as a sheet support surface for the sheets as the sheets are transported through recurling means 44. Once engaged between recurler roller 54 and recurler belts 46, the paper sheet is forced to curve around a portion of recurler roller 54. The height of recurler roller 54, with respect to the other rollers within the group, may be adjusted to increase or decrease the tension in recurler belts 46, and the angle through which the sheets must pass. By varying the height of recurler roller 54, recurling means 44 may be adjusted to compensate for curl caused by varying paper weights, temperatures, and humidity. Where the height of recurler roller 54 is adjustable, guiding means 58' may similarly be raised or lowered to assure the sheets are properly fed between recurler roller 54 and the outer run of recurler belts 46. The mechanism to raise or lower recurler roller 54 may also raise or lower guiding means 58'. Where it is desirable to remove or reduce curl-up in the sheets, recurler roller 54 should be placed generally below feed roller 50 and forward roller 52, as shown in FIG. 5.

After the sheets are fed over recurler roller 54, forward roller 52 directs the sheets toward a substantially horizontal conveying means 60. Recurling means 44 regulates the speed of the sheets as they are delivered to conveying means 60. Controlling the speed of the sheets is important to assure that the sheets are properly positioned along conveying means 60 for proper engagement with deflecting means 62.

Conveying means 60 extends substantially across the width and length of the enclosure from near entrance opening 36 to near exit opening 38. Conveying means 60 is capable of transporting sheets through the enclosure along conveying path 43. Conveying means 60 has a foraminous conveyor belt assembly trained about drive roller 48, forward roller 52, and a rearward roller 70. Each roller is rotatably secured to support frame 22, with rearward roller 70 being locating near exit opening 38. Drive roller 48, forward roller 52, and rearward roller 70 are positioned to cause conveyor belt assembly to be adjustably and rotatably taut, with drive roller 48 and motor 56 rotating conveyor belt assembly.

Conveyor belt assembly preferably comprises a plurality of relatively flat, parallel, spaced-apart, continuous conveyor belts 72. Conveyor belts 72, which substantially span the entire length of the enclosure, help control the curling as the sheets travel along conveying path 43. If rollers were used rather than conveyor belt assembly, the sheets may curl and jam into the spaces between the rollers, wheels, or deflecting means. Rollers also frequently mark or smear the transported sheets.

Conveyor belts 72 and recurler belts 46 are preferably made of a porous, mesh-like, flexible and stretchable material, such as a spandex material. Conveyor belts 72 and recurler belts 46 may also have a tacky outer surface 74 which contacts the sheets as the sheets are passed into and through the enclosure. Due to a high coefficient of friction, tacky outer surface 74 effectively assists recurling means 44 and conveying means 60 to transport the sheets through the enclosure. Tacky outer surface 74 may comprise a thin film of silicone placed upon the outer surface of conveyor belts 72 and recurler belts 46.

Drive roller 48, feed roller 50, forward roller 52, and rearward roller 70 may be provided with a means for maintaining the position of recurler belts 46 and/or conveyor belts 72 which are trained about them. The position of recurler belts 46 and conveyor belts 72 may be maintained by providing a crown at the location where each belt contacts each roller, or by providing raised guides to restrict the sideways movement of each belt.

Alternatively, only drive roller 48 and rearward roller 70 are provided with a means for maintaining the position of recurler belts 46 and/or conveyor belts 72, which are trained about them, by providing a crown at the location where each belt contacts these rollers. Such an embodiment increases the area of contact between the sheets and the belts, reduces the number of elements that are necessary to practice the invention, and reduces the possibility that the sheets will be marked or creased by the crested wheels. A reduction in the number of elements also reduces manufacturing costs. This alternative embodiment is shown in FIG. 5 with feed roller 50' and forward roller 52' not having crested wheels.

Located below and in close proximity to conveying means 60 is a deflecting means 62. Deflecting means 62 serves the following dual purposes: defining a series of sheet support surfaces 76 against which the sheets are pressed while being conveyed along conveying path 43; or defining a plurality of sheet deflecting surfaces 78 against which the sheets are urged to deflect and sort the sheets downward into tray assembly 80. Deflecting means 62 comprises a plurality of relatively flat, parallel, abutting deflectors 64 which substantially span the width of conveying means 60. The upper, sheet support surface 76 of each deflector 64 is relatively flat. The lower, sheet deflecting surface 78 is slightly concave. Both the sheet support surface 76 and the sheet deflecting surface 78 have a relatively low coefficient of friction. Each successive deflector 64 substantially abuts the previous deflector to prevent the sheets from becoming jammed therebetween.

Deflectors 64 are movably mounted to support frame 22, and each pivots about its own longitudinal axis 82 between a disengaged position and an engaged position. The position of deflectors 64 is controlled by the printer or duplicator which feeds the sheets into sorting apparatus 20.

In its normally at rest or disengaged position, deflector 64 serves as an active, sheet support surface 76 for the oncoming sheets, allowing the sheets to move past the deflector without being deflected. Deflector 64 is normally biased by gravity, due to the positioning of the longitudinal axis 82, toward the disengaged position. Deflector 64 may also be biased toward the disengaged position by a spring means 84.

Figure 3:
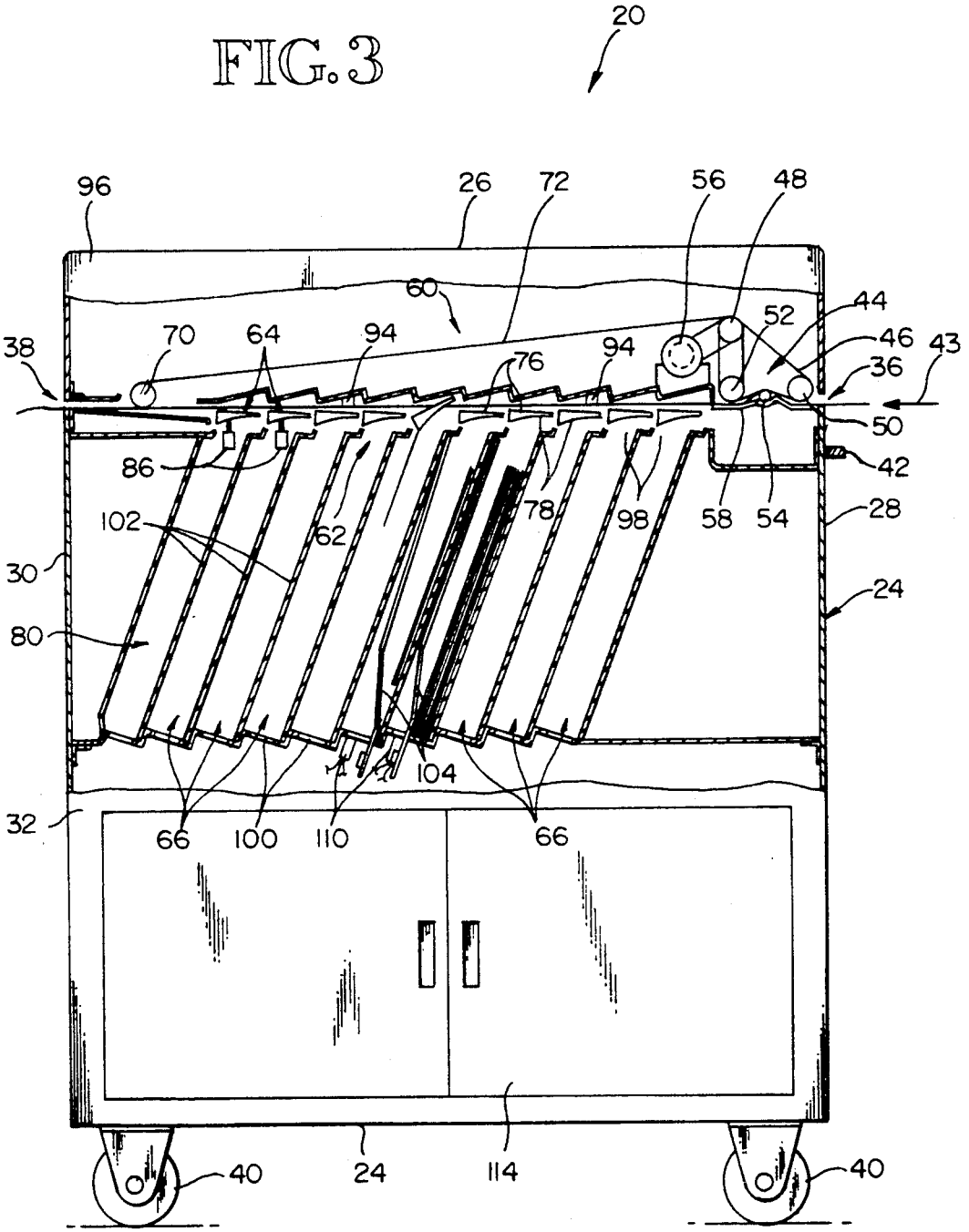
FIG. 3 is a side elevational view of the present invention as shown in FIG. 1 and FIG. 2 with a portion of the front wall broken away.
Figure 12:
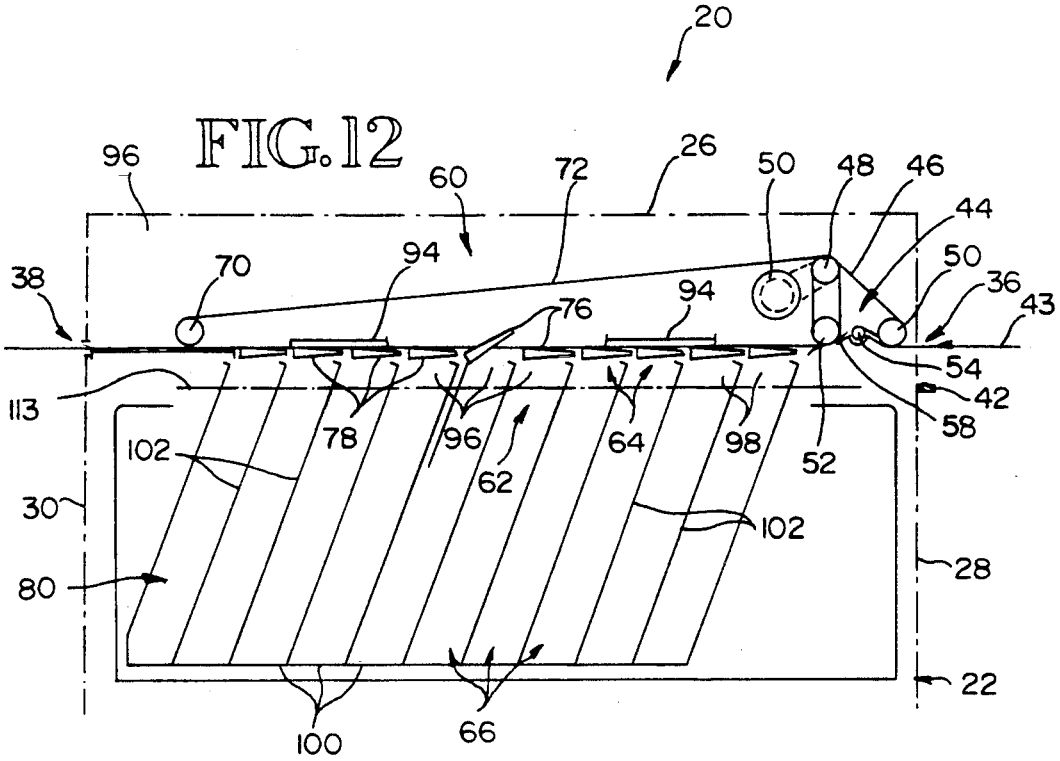
FIG. 12 is a schematic, partial side elevational view of the present invention as shown in FIG. 3.
Figure 13:
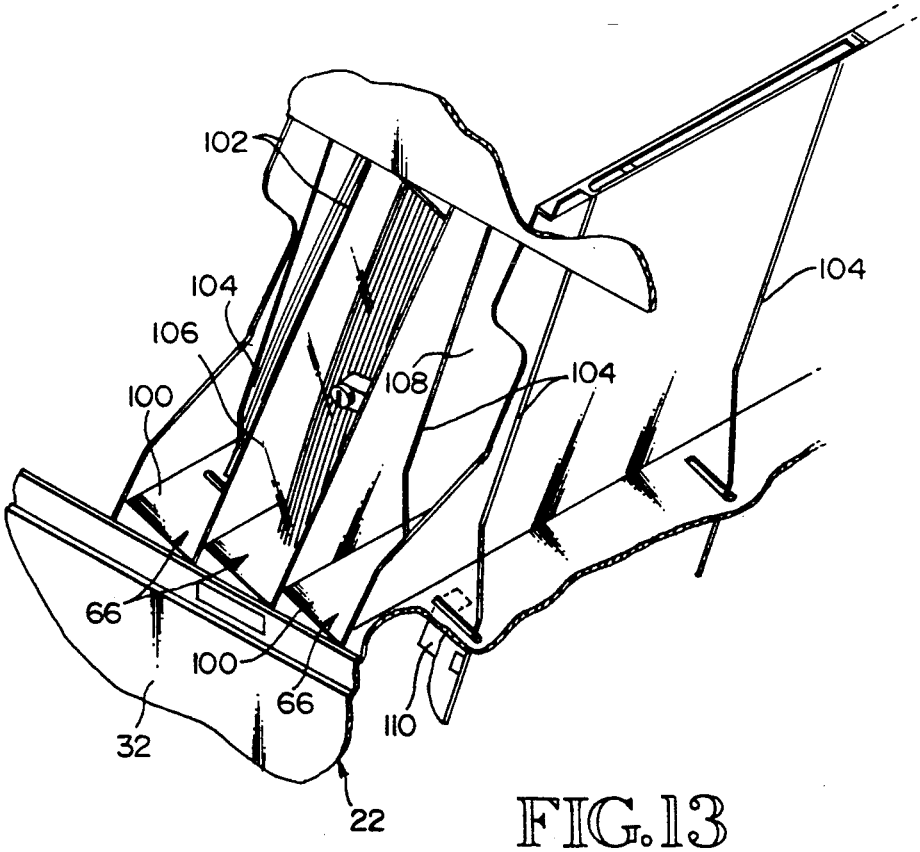
FIG. 13 is a partial perspective view of a lockable door located on a receiving tray.

By actuating a solenoid means 86, deflector 64 is pivoted toward an engaged position. In the engaged position, the lower sheet deflecting surfaces 78 extend into conveying path 43 and urge the sheets away from conveying means 60 downward along a different path toward tray assembly 80. Support frame 22 and the housing of conveying means 60 are designed to permit deflector 64 to extend into conveying path 43. In the preferred embodiment, support frame 22 is designed with a ripple board pattern as shown in FIG. 3, thereby allowing a portion of sheet deflecting surface 78 to be raised above the outer surface of conveyor belt assembly.

Since a low operating noise level is desired, a noise-suppressant 93 material is used to define a disengaged position stop 88 and an engaged position stop 90. The noise-suppressant 93 material is mounted upon a stop bar 92. When in the disengaged position, deflector 64 rests against disengaged position stop 88 on stop bar 92. When in the engaged position, deflector 64 rests against engaged position stop 90 on stop bar 92.

Once recurled, the sheets are conveyed along conveying path 43, juxtaposed between conveying means 60 and deflecting means 62. Lightweight pressure straps 94, secured to support frame adjacent and above the lower run of conveyor belt assembly, press conveyor belts 64 down against the sheets. By pressing conveyor belts 72 against the sheets, the sheets are urged against deflecting means 62. Tacky outer surfaces 74 of conveyor belts 72 grip the sheets, easily overcoming the frictional resistance of sheet support surface 76, and convey the sheets along conveying path 43.

Figure 2:
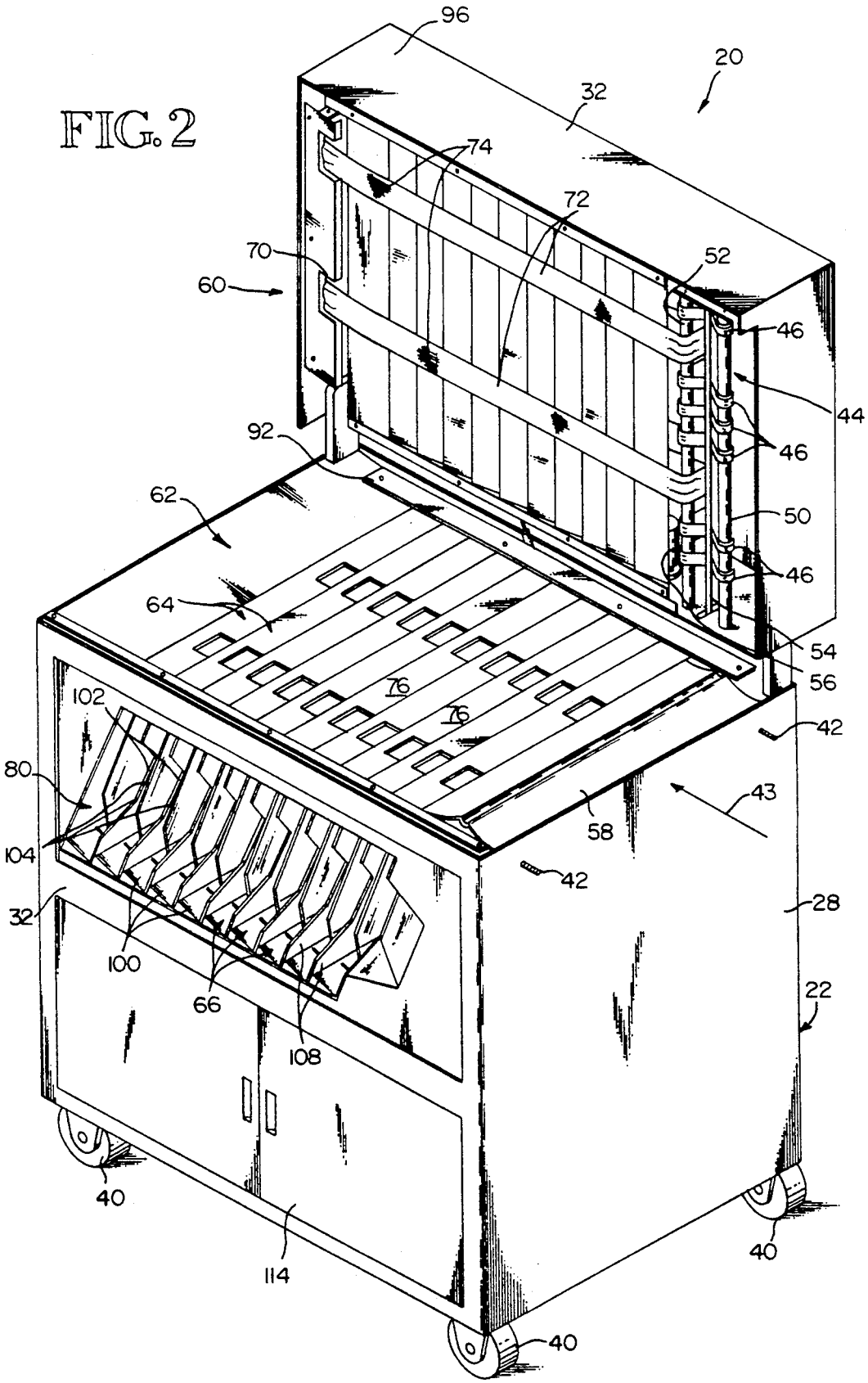
FIG. 2 is a perspective view of the present invention as shown in FIG. 1 with the conveying means and recurling mean being located upon a raised, hinged canopy.

Conveying means 60 and recurling means 44 may be positioned within a pivotal canopy 96 which in turn is attached to support frame 22. Pivotal canopy 96 allows conveying means 60 and recurling means 44 to pivot or lift away from deflecting means 62. This facilitates easy access to conveying means 60 and deflecting means 62 for maintenance of sorting apparatus 20 and for the removal of any sheets which might become jammed within the enclosure. In FIG. 2, guiding means 58 is shown as not being attached to canopy 96. An alternative and preferred embodiment is shown in FIG. 6, where guiding means 58' is shown attached to canopy 96 with a portion being broken away to show recurling means 44.

Tray assembly 80 is secured to support frame 22 below deflecting means 62. Tray assembly 80 comprises a plurality of receiving trays 66. In the preferred embodiment, tray assembly 80 has ten receiving trays 66 which are horizontally indexed, and inclined slightly from the vertical, below deflecting means 62. Each receiving tray 66 has a deflector 64 associated therewith. Each receiving tray 66 has a tray entrance 98 near conveying means 60, a tray floor 100 for supporting the sheets deposited therein, a tray side wall 102 against which the sheets are urged, at least one paper-bail means 104 to urge the sheets against tray side wall 102, and a tray opening 108 through which the sheets may be removed from within the enclosure.

As a sheet is deflected into tray assembly 80 by deflector 64, the sheet traverses tray entrance 98. Tray entrance 98 extends substantially across the width of conveying means 60. Paper-bail means 104 guides the sheet into the receiving tray 66 corresponding to the engaged deflector 64. Paper-bail means 104 assures the proper orientation and direction of the sheets as they are deposited into job stacks within receiving tray 66.

Where a plurality of receiving trays 66 are used, the tray assembly 80 may define a "mailbox system". Access to a particular receiving tray 66 may be restricted by employing a lockable door 106 at tray opening 108 to prevent unauthorized inspection of the sheets within receiving tray 94.

A capacity sensing means 110, secured to support frame 22, may be incorporated into sorting apparatus 20 to sense when receiving tray 66 is full. Once triggered, capacity sensing means 110 causes deflecting means 62 to remain in the disengaged position until receiving tray 66 is emptied. Capacity sensing means 110 may comprise a magnetic switch which is triggered by the proximity of paper-bail means 104 to a magnetic switch.

A sheet-delivery sensing means, secured to support frame 22, may be used to sense whether the sheets are being properly deposited within tray assembly 80. Sheet-delivery sensing means may be a light-sensitive switch which is triggered by the sheets passing an optical path 113 within tray assembly 80. Should sheet-delivery sensing means indicate that a sheet was not properly deposited or that a sheet has become jammed within the enclosure, sheet-delivery sensing means would cause the activation of an operator warning signal.

Support frame 22 may also be provided with a storage cabinet 114 located below tray assembly 80 for storing paper or maintenance supplies.

In compliance with the statute, the invention has been described in language generally specific as to structural features. Since the means and construction herein disclosed comprise the preferred form of putting the invention into effect, it is to be understood that the invention is not limited to the specific features shown herein. The invention is, therefore, claimed in any of its forms or modifications within the legitimate and valid scope of the appended claims, appropriately interpreted in accordance with the doctrine of equivalents.

INDUSTRIAL APPLICABILITY

This invention is particularly adapted for the uninterrupted transporting, sorting, and stacking of large quantities of paper sheets as often needed for the effective use of large mainframe or commercial printing and duplicating equipment. Provisions are made for recurling the sheets upon entering the enclosure of the sorting apparatus and for selectively sorting the sheets into distinct job stacks within individual receiving trays. The receiving trays may be designated as "mailboxes". Security measures are also provided for restricting access to the sheets within the secured receiving trays.

We claim:

1. An apparatus for conveying and deflecting sheets comprising:

a) a conveyor belt assembly having a plurality of spaced-apart continuous conveyor belts comprised of a stretchable spandex-type material for transporting said sheets along a conveying path, said belt having an inner surface and an outer, sheet contacting, surface;

b) a plurality of deflectors each for selectively supporting or deflecting said sheets, said deflectors having an upper surface, a lower surface, a disengaged position, an engaged position, and a forward edge, each of said deflectors disposed within a support frame of said apparatus for rotation about the longitudinal axis, the plurality of the upper surfaces of said deflectors which are in their disengaged positions defining a sheet support surface for supporting said sheets traveling along said conveying path, said lower surface of each of said deflectors when in said engaged position extending into said conveying path each thereby defining a sheet deflecting surface for deflecting said sheets away from said conveying path; and c) pressure means to urge said sheets against said sheet support surface as they are transported along said conveying path.

2. The apparatus of claim 1, wherein said outer surface of at least one of said conveyor belts has a high coefficient of friction relative to said sheet support surface to assist said conveyor belts in transporting said sheets along said conveying path.

3. The apparatus of claim 2, wherein said outer surface comprises a thin film of silicone placed upon said conveyor belt.

4. An apparatus for conveying and deflecting sheets comprising:

a) a conveyor belt assembly having a plurality of spaced-apart continuous conveyor belts for transporting said sheets along a conveying path, each of said belts having an inner surface and an outer, sheet contacting, surface;

b) a plurality of deflectors each for selectively supporting or deflecting said sheets, said deflectors having an upper surface, a lower surface, a disengaged position, an engaged position, and a forward edge, each of said deflectors disposed within a support frame of said apparatus for rotation about the longitudinal axis, the plurality of the upper surfaces of said deflectors which are in their disengaged positions defining a sheet support surface for supporting said sheets traveling along said conveying path, said lower surface of each of said deflectors when in said engaged position extending into said conveying path each thereby defining a sheet deflecting surface for deflecting said sheets away from said conveying path;

c) pressure means to urge said sheets against said sheet support surface as they are transported along said conveying path; and d) wherein each said deflector is urged against a noise-suppressant material, said noise-suppressant material defining a disengaged position stop when said deflector is in said disengaged position and defining an engaged position stop when said deflector is in said engaged position.

5. An apparatus for conveying, transporting, sorting and stacking sheets into at least one job stack comprising the combination of:

(a) a support frame defining an enclosure, said support frame having an entrance opening through which said sheets may enter said enclosure, said support frame having an exit opening from which said sheets may be expelled from within said enclosure of said sheets not sorted and stacked within said apparatus;

(b) a conveying means for conveying said sheets along a conveying path through said enclosure, said conveying means having a conveyor belt assembly, said conveyor belt assembly having a plurality of spaced-apart, continuous conveyor belts trained about a forward roller and a rearward roller, said forward roller and said rearward roller being rotatably secured to said support frame, said conveying means being capable of transporting said sheet through said enclosure along said conveying path;

(c) a deflecting means for supporting, directing, and sorting said sheets, said deflecting means being movably mounted to said support frame, said deflecting means having at least one deflector, said deflector having an upper surface, a lower surface, a disengaged position, and an engaged position, said sheets being juxtaposed between said conveying means and said deflector in said disengaged position, said upper surface of said deflector in said disengaged position defining a sheet support surface for supporting said sheets traveling along a conveying path, said lower surface of said deflector in said engaged position extending into said conveying path thereby defining a sheet deflecting surface for deflecting said sheets away from said conveying path, said conveying means being urged against said sheets to press said sheets against said deflecting means; and (d) a noise-suppressant material against which said deflector is urged, said noise-suppressant material defining a disengaged position stop when said deflector is in said disengaged position and defining an engaged position stop when said deflector is in said engaged position.

6. The apparatus of claim 5, further comprising a recurling means secured to said support frame for recurling said sheets as said sheets enter said conveyor belt assembly.

7. The apparatus of claim 6 wherein said recurling means comprises a recurler roller adjustably secured to said support frame to permit the height of said recurler roller with respect to a feed roller and a forward roller, to be increased or decreased for respectively increasing and decreasing the angle through which said sheets must pass when passing through said recurler means.

8. The apparatus of claim 5, further comprising one or more magnets attached to a wall of said support frame nearest said entrance roller for securing said apparatus to a supply source of said sheets and one or more locating pins on said wall for aligning said apparatus to said supply source.

9. The apparatus of claim 8 further comprising alignment holes located in a wall of said support frame nearest said exit roller, said holes corresponding to said alignment pin, for aligning one or more of these apparati in end-to-end fashion.

10. The apparatus of claim 9 joined end-to-end with another apparatus of claim 9.

11. The apparatus of claim 5, wherein said conveying means is positioned within a pivotal canopy attached to said support frame thereby allowing said conveyor means to be pivoted away from said deflecting means to facilitate the maintenance of said apparatus and the removal of said sheets which possibly may become jammed within said enclosure.

12. The apparatus of claim 5 further comprising a tray assembly positioned below said deflecting means and secured to said support frame, said tray assembly having at least one receiving tray for stacking said sheets into at least one job stack, each said receiving tray inclined from the vertical, said receiving tray having at least one paper bail for urging said sheets against a tray side wall.

13. The apparatus of claim 12, further comprising a capacity sensing means secured to said support frame for sensing when said receiving tray is full, said capacity sensing means causing one or more of said deflectors to maintain said disengaged position until said receiving tray is emptied.

14. The apparatus of claim 13, wherein said capacity sensing means is a magnetic switch which is triggered by the proximity of said paper-bail to said magnetic switch.

15. The apparatus of claim 12 wherein said tray assembly comprises one receiving tray located beneath each of said deflectors for receiving a sheet deflected by said deflector.

16. The apparatus of claim 15, further comprising a sheet-delivery sensing means secured below said deflectors to said support frame for sensing whether said sheets have fallen into said tray assembly, said sheet-delivery sensing means causing the activation of an operator warning signal should any of said sheets have jammed between said deflectors and said tray assembly.

17. The apparatus of claim 16, wherein said sheet-delivery sensing means is a light-sensitive switch which is triggered as said sheets pass an optical path in said tray assembly.

18. The apparatus of claim 15, further comprising at least one receiving tray having a lockable door to prevent unauthorized inspection of said sheets within said receiving tray.

19. The apparatus of claim 5, wherein said conveyor belt assembly further comprises an entrance roller and an exit roller, at least one of said rollers equipped with one or more crowns, each crown for maintaining the position of one of said belts on said roller.

20. An apparatus comprising a plurality of deflectors each for selectively supporting or deflecting sheets, each of said deflectors having an upper surface, a lower surface, a disengaged position, and an engaged position, each of said deflectors disposed within a support frame of said apparatus for rotation about the longitudinal axis, a plurality of the upper surfaces of said deflectors which are in their disengaged position defining and providing a sheet support surface which is substantially the only support surface for supporting said sheets traveling along said conveying path, said lower surface of each of said deflectors when in said engaged position extending into said conveying path each thereby defining a sheet deflecting surface for deflecting said sheets away from said conveying path.

21. The apparatus of claim 20 wherein said plurality of the upper surfaces of said deflectors which are in their disengaged positions provide the only sheet support surface for supporting said sheets traveling along said conveying path.

22. An apparatus for conveying and deflecting sheets comprising:

(a) a conveyor belt assembly having a plurality of spaced-apart, continuous conveyor belts for transporting said sheets along a conveying path, said belt having an inner surface and an outer, sheet contacting, surface;

(b) a plurality of deflectors each for selectively supporting or deflecting said sheets, said deflectors having an upper surface, a lower surface, a disengaged position, an engaged position, and a forward edge, each of said deflectors disposed within a support frame of said apparatus for rotation about a longitudinal axis, the plurality of the upper surfaces of said deflectors which are in their disengaged positions defining a sheet support surface for supporting said sheets traveling along said conveying path, said lower surface of each of said deflectors when in said engaged position extending into said conveying path each thereby defining a sheet deflecting surface for deflecting said sheets away from conveying path; and (c) at least one pressure strap secured to said support frame to urge said conveyor belt against said sheets for pressing said sheets against said sheet support surface as they are transported along said conveying path.

23. An apparatus comprising a recurling means for recurling sheets, said recurling means being a positive drive mechanism secured to a support frame, said recurling means having a plurality of continuous recurler belts trained about a drive roller, a feed roller, and a forward roller, said feed roller being positioned at approximately the same elevation as said forward roller, said recurling means further having a recurler roller, said recurler roller being urged against the outer run of said recurler belts, said drive roller being rotatably attached to a powered rotating motor, thereby driving said recurler belts, said recurler belts engaging and rotating said feed roller, said forward roller, and said recurler roller, said recurler roller having a relatively small cross-sectional diameter, said recurler roller being adjustably secured to said support frame to permit the height of said recurler roller, with respect to said feed roller and said forward roller, to be increased or decreased, thereby increasing or decreasing the tension in said recurler belts and the angle through which said sheets must pass when passed between said recurler roller and said recurler belts.

* * * * *